US010399081B2

(12) United States Patent
Petack et al.

(10) Patent No.: US 10,399,081 B2
(45) Date of Patent: Sep. 3, 2019

(54) CRUSHING ROLL FOR A CRUSHER

(71) Applicant: TAKRAF GmbH, Leipzig (DE)

(72) Inventors: Burkhard Petack, Senftenberg (DE); Marko Schmidt, Stauchitz OT Treben (DE); Karsten Ebenhan, Dresden (DE); Patrick Neufeldt, Finsterwalde (DE)

(73) Assignee: TAKRAF GmbH, Leipzig (DE)

( * ) Notice: Subject to any disclaimer, the term of this patent is extended or adjusted under 35 U.S.C. 154(b) by 0 days.

(21) Appl. No.: 15/131,004

(22) Filed: Apr. 17, 2016

(65) Prior Publication Data

US 2016/0303571 A1 Oct. 20, 2016

(30) Foreign Application Priority Data

Apr. 17, 2015 (DE) ..... 10 2015 206 957

(51) Int. Cl.
*B02C 4/00* (2006.01)
*B02C 4/30* (2006.01)
*B02C 4/08* (2006.01)

(52) U.S. Cl.
CPC ..... *B02C 4/305* (2013.01); *B02C 4/08* (2013.01); *B02C 2210/02* (2013.01)

(58) Field of Classification Search
CPC ..... B02C 4/305; B02C 4/08; B02C 2210/02
(Continued)

(56) References Cited

U.S. PATENT DOCUMENTS 2,829,695 A * 4/1958 Jarvis ..... A01F 29/095 241/227
2,849,038 A * 8/1958 Clark ..... B27L 11/02 144/172

(Continued)

FOREIGN PATENT DOCUMENTS

CN 201200902 Y 3/2009
CN 202238161 U 5/2012

(Continued)

OTHER PUBLICATIONS

Office Action issued in German Patent Application No. DE 10 2015 206 957.5 (German Counterpart of U.S. Appl. No. 15/131,004), dated Dec. 9, 2015 (Original Version in German).

(Continued)

*Primary Examiner* — Faye Francis
(74) *Attorney, Agent, or Firm* — FisherBroyles, LLP; Andrew K. Gonsalves, Esq.

(57) ABSTRACT

The present invention relates to a crushing roll for a roll-type crusher has a shaft with at least one groove extending in the axial direction on its lateral surface, to receive formed elements. The formed elements serve to retain the crushing shells, for which purpose the formed elements form a form-interlockingly engaging combination with the groove in the shaft, in the radial direction. A "form-interlockingly engaging combination in the radial direction" is understood here to signify means of blocking of movement of the formed elements in the radial direction of the shaft. In this way, it is possible to anchor the crushing shells in the grooves by means of the formed elements. Advantageously, also axial forces from the crushing shells can be transmitted to the shaft via the formed elements in the grooves, which forces can thereby be borne by the shaft, given that a high pressing force can be transmitted via the combination of a (Continued)

crushing shell and formed element, resulting in high holding friction between the molded element and the shaft.

10 Claims, 2 Drawing Sheets

(58) Field of Classification Search
USPC ..... 241/294
See application file for complete search history.

(56) References Cited

U.S. PATENT DOCUMENTS

| | | | | |
|---|---|---|---|---|
| 3,037,540 | A * | 6/1962 | Bloomquist | B02C 18/142 241/235 |
| 3,974,970 | A * | 8/1976 | Bertrand | A01F 29/06 241/222 |
| 4,930,710 | A * | 6/1990 | Hench | B02C 18/186 241/294 |
| 6,325,580 | B1 * | 12/2001 | Diamond | F16B 37/067 411/183 |
| 6,343,755 | B1 * | 2/2002 | Barclay | B02C 18/142 241/236 |
| 2004/0251360 | A1 | 12/2004 | Everson et al. | |
| 2006/0102762 | A1 * | 5/2006 | Garcia | B02C 18/186 241/294 |
| 2015/0217295 | A1 * | 8/2015 | Niklewski | B30B 11/165 241/294 |

FOREIGN PATENT DOCUMENTS

| | | | |
|---|---|---|---|
| CN | 202460712 | U | 10/2012 |
| CN | 202638476 | U | 1/2013 |
| CN | 202700562 | U | 1/2013 |
| CN | 103769268 | A | 5/2014 |
| CN | 203611118 | U | 5/2014 |
| CN | 204051759 | U | 12/2014 |
| DE | 10 2014 103 657 | A1 | 10/2014 |
| EP | 0 110 665 | A2 | 6/1984 |
| GB | 2352412 | A | 1/2001 |
| RU | 2013102118 | A | 7/2014 |
| WO | 2014033609 | A2 | 3/2014 |
| WO | 2014/170371 | A2 | 10/2014 |

OTHER PUBLICATIONS

Office Action issued in German Patent Application No. DE 10 2015 206 957.5 (German Counterpart of U.S. Appl. No. 15/131,004), dated Dec. 9, 2015 (English Translation).

Examination Report issued in Australian Patent Application No. 2016202394 (Australian Counterpart of U.S. Appl. No. 15/131,004), dated Dec. 2, 2016.

Office Action issued in Chinese Patent Application No. 201610239437.X (Chinese Counterpart of U.S. Appl. No. 15/131,004), dated Mar. 7, 2017 (English Translation).

Polish Patent Office, Search Report issued in Polish Patent Application No. P.416865 (Polish Counterpart of U.S. Appl. No. 15/131,004), dated Sep. 6, 2016.

Eurasian Patent Office, Search Report issued in Eurasian Patent Application No. 201600258 (Eurasian Counterpart of U.S. Appl. No. 15/131,004), published Nov. 30, 2016.

* cited by examiner

CRUSHING ROLL FOR A CRUSHER

CROSS-REFERENCE TO RELATED APPLICATIONS

This application claims priority benefit under 35 U.S.C. § 119 of German Patent Application No. 10 2015 206 957.5, filed Apr. 17, 2015, the entire contents of which are incorporated herein by reference.

FIELD OF THE INVENTION

The present invention relates to a crushing roll for a roll-type crusher, and further relates to a roll-type crusher.

BACKGROUND OF THE INVENTION

Roll-type crushers have at least two crushing rolls bearing crushing shells with crushing implements, on the surface of the rolls. The crushing shells and implements experience appreciable wear during the crushing operation, and accordingly it is desirable to be able to replace them in the simplest possible manner.

Toward this end, in EP 0110665 A2 it is proposed to combine the crushing shells with intermediate discs in a form-interlocking manner, with the intermediate discs being rotationally rigidly disposed on the shaft of the crusher. The manner of form-interlocking between the crushing shell and intermediate disc is arranged such that forces which arise during the crushing operation can be well accommodated. A drawback of this solution is that the crushing shells may be removed only laterally, in the axial direction, and thus in order to replace an interior crushing shell it is necessary to remove all interposed crushing shells.

Also, in US 2004/0251360 A1, a similar configuration employing intermediate discs and crushing shells which latter form-interlockingly engage with the intermediate discs is proposed. Here the form-interlocking is obtained via an insert block which enables a given crushing shell to be accommodated independently from other crushing shells. This solution has the drawbacks that assembly costs are high, with a plurality of components for attaching the crushing shells, and it is highly likely that individual crushing shells will experience jamming, resulting in difficulty in removing the shells.

In EP 0110665 A2 (same as above), a shaft for a roll-type crusher is disclosed which has mutually parallel grooves on its surface which extend longitudinally along the roll. Crushing shells can be accommodated in these grooves, whereby the shells form-interlockingly engage the shaft in the radial direction. The crushing implement is accommodated via a bore in the crushing shell. The crushing shell is anchored directly, by attachment in the groove of the shaft. A drawback of this solution is that the crushing shells correspond to formed elements. As a result of this dual function, under conditions of high loads the crushing shell is subjected to increased wear, necessitating more frequent repair, and higher maintenance costs.

In DE OS 10 2014 103657 A1, a shaft is described which bears releasably attached crushing shells on its lateral surface, which crushing shells bear the crushing implement. The shaft has grooves which respectively accommodate a member extending from the crushing shell.

A wedge-shaped piece is disposed in the groove, which piece is adjustable by means of a screw. The screw is screwed directly into a threaded bore in the shaft, and the wedge-shaped piece is adjusted toward an assembly position at the base surface of the groove. A drawback of this solution is that the direct mounting of the crushing shell in the shaft results in lower stability and higher wear.

The present invention is directed to addressing these and other deficiencies in the art.

SUMMARY OF THE INVENTION

One object of the present invention is to provide a crushing roll for a crusher, which crushing roll enables a more secure but also easy and economical means of attaching the crushing shells, and allows individual crushing shells to be replaced without problems.

Therefore, in one aspect, the present invention relates to, inter alia, a crushing roll and a roll-type crusher as described herein.

In one embodiment, the present invention provides a crushing roll for a roll-type crusher having a shaft with at least one groove extending in the axial direction on its lateral surface, to receive formed elements. The formed elements serve to attach the crushing shells, for which purpose the formed elements form a form-interlockingly engaging combination with the groove in the shaft, in the radial direction. A "form-interlockingly engaging combination in the radial direction" is understood here to signify means of blocking of movement of the formed elements in the radial direction of the shaft. In this way, it is possible to anchor the crushing shells in the grooves by means of the formed elements.

Advantageously, axial forces from the crushing shells can be transmitted to the shaft via the formed elements in the grooves, which forces can thereby be borne by the shaft, given that a high compressive force can be transmitted via the combination of a crushing shell and formed element, resulting in high holding friction between the molded element and the shaft.

Advantageously, this shaft also makes it possible to replace the crushing shells individually when the crushing roll is in the assembled state. Significantly, the configuration is easy and thereby economical to fabricate.

These and other objects, features, and advantages of this invention will become apparent from the following detailed description of the various aspects of the invention taken in conjunction with the accompanying drawings.

BRIEF DESCRIPTION OF THE DRAWINGS

For the purpose of illustrating aspects of the present invention, there are depicted in the drawings certain embodiments of the invention. However, the invention is not limited to the precise arrangements and instrumentalities of the embodiments depicted in the drawings. Further, if provided, like reference numerals contained in the drawings are meant to identify similar or identical elements.

DETAILED DESCRIPTION OF THE INVENTION

Figure 1:
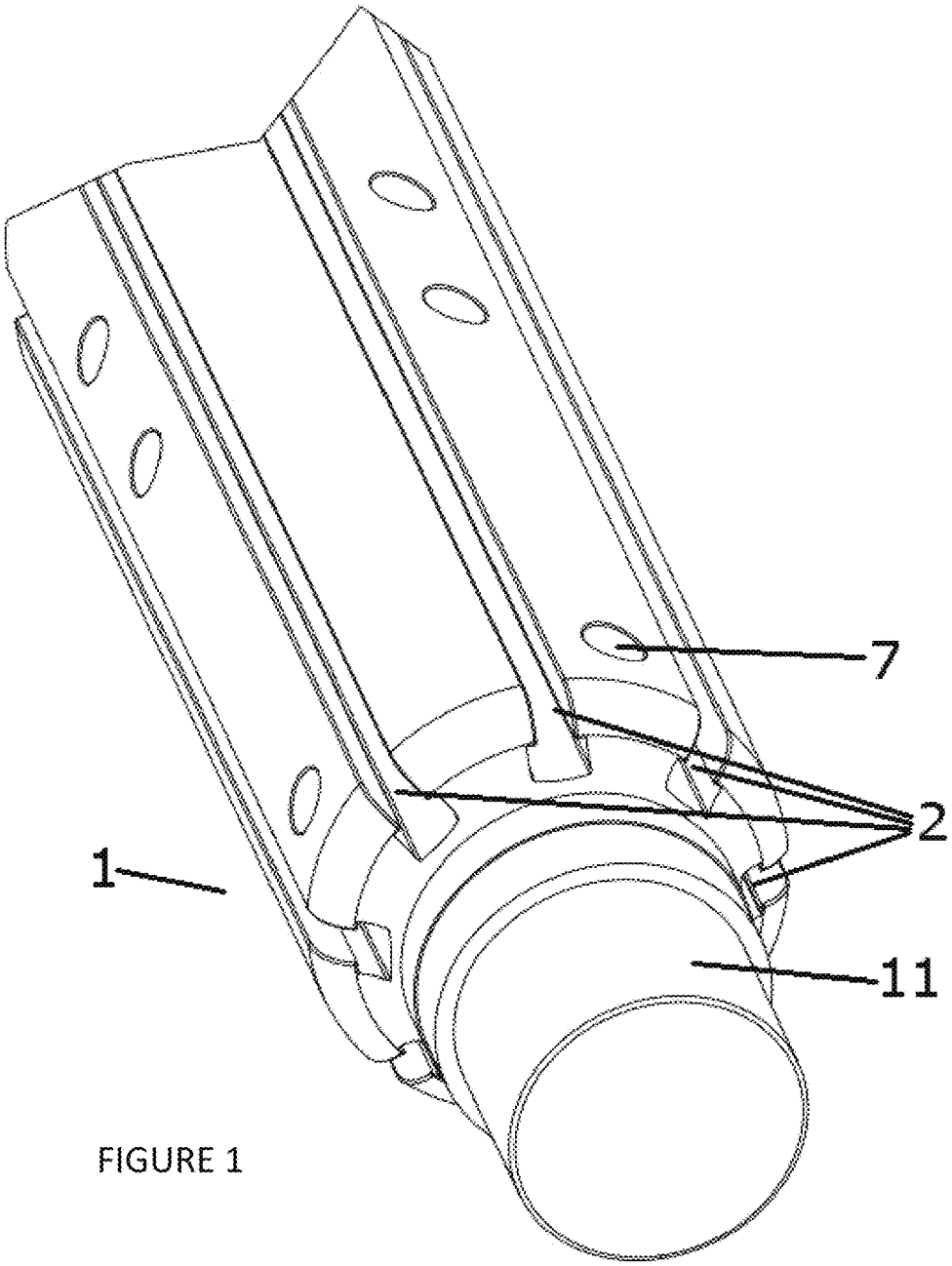
FIG. 1 is a perspective view of one embodiment of a shaft of the present invention.

The present invention provides, inter alia, a crushing roll for a roll-type crusher, and further relates to a roll-type crusher.

Therefore, in one aspect, the present invention relates to a crushing roll for a crusher, which crushing roll enables a more secure but also easy and economical means of attaching the crushing shells, and allows individual crushing shells to be replaced without problems.

In one embodiment, the present invention provides a crushing roll for a roll-type crusher having a shaft with at least one groove extending in the axial direction on its lateral surface, to receive formed elements. The formed elements serve to attach the crushing shells, for which purpose the formed elements form a form-interlockingly engaging combination with the groove in the shaft, in the radial direction. A "form-interlockingly engaging combination in the radial direction" is understood here to signify means of blocking of movement of the formed elements in the radial direction of the shaft. In this way, it is possible to anchor the crushing shells in the grooves by means of the formed elements.

Advantageously, axial forces from the crushing shells can be transmitted to the shaft via the formed elements in the grooves, which forces can thereby be borne by the shaft, given that a high compressive force can be transmitted via the combination of a crushing shell and formed element, resulting in high holding friction between the molded element and the shaft.

Advantageously, this shaft also makes it possible to replace the crushing shells individually when the crushing roll is in the assembled state. Significantly, the configuration is easy and thereby economical to fabricate.

In a preferred embodiment of the invention, a linking element is disposed between the shaft and the crushing shells, which linking element forms a means of support for the crushing shells. The linking element has radial bores above the grooves, through which the attaching elements can be passed. Preferably, the bores are longitudinal bores extending in the direction of the grooves, thus in the axial direction of the shaft.

In an alternative and particularly preferred embodiment, the crushing shells rest directly on the shaft and are anchored in the formed elements.

A further preferred feature is that the shaft has adjusting bolts or receiving means for adjusting bolts, on its lateral surface between the grooves. If an additional linking element is provided between the shaft and the crushing shells, the adjusting bolt (or receiving means for an adjusting bolt) is disposed in the lateral surface of the linking means. Crushing shells resting on the shaft or on the linking means have adjusting bolts (or receiving means therefor), so that tangential and/or axial movement of the crushing shells between the shaft and crushing shell or between the linking element and the crushing shell are/is impeded.

In alternative embodiment, receiving means for adjusting bolts are disposed on the shaft (or on the linking element) and on the underside of each crushing shell. The adjusting bolts are round steel rods that are accommodated in both receiving means. The length of the adjusting bolts should be set such that good form-interlocking force is exerted in both of the receiving means, while at the same time the crushing shell can be supported on the shaft (or linking element) without interference.

It is particularly preferred for the adjusting bolts to be round steel rods, and for the receiving means to be bores.

Preferably, at least one groove is T-shaped. In this case, the horizontal part of the T is a secant of the cross-sectional area, from which the vertical (lower) part of the T extends outwardly. In the simplest case, the formed elements are rectangular members, which are accommodated in the horizontal part of the T.

Alternatively, other shapes for the grooves are conceivable, and possible. The grooves must only satisfy the requirement that they prevent movement of the formed elements in the radial direction out from the shaft. An example of such a shape is a wedge shape (although a T-shape is preferred because of improved force transmission).

It is also preferred if at least one side of the groove is open at the end faces of the shaft, so that the formed elements can be slid onto the shaft from its end face.

It is also preferable if the shaft is flattened (flat) in the region of the grooves. Thus, it is advantageous if a defined support surface for the crushing shells is provided. Preferably, a crushing shell rests on two flattened areas of the grooves, allowing a defined, non-wobbling support.

The inventive crushing roll has a shaft as described above. The crushing shells are anchored in the formed elements by means of fastening elements.

Preferably, the fastening elements comprise screws, which preferably engage threaded bores in the formed elements. The threaded bore in a formed element is disposed such that it is accessible to the screws through the groove.

It is particularly preferred for the formed elements to be symmetric with respect to the axis of the threaded bore. Thereby one can prevent tilting. The formed elements are preferably rectangular or T-shaped elements. In a very simple variant, normal hex nuts may be installed. Preferably the formed elements have at least one threaded bore, and may have a plurality of threaded bores. Thus a single formed element may have a plurality of longitudinal threaded bores, to accommodate a plurality of attaching elements.

It is preferred for each crushing shell to be attached with three screws, particularly preferably four or five screws.

Preferably, when assembling the crushing roll, distancing elements are pushed into the grooves between the formed elements, so that, advantageously, the formed elements are positioned at the correct positions for attaching the crushing shells. In an alternative configuration, the formed elements and the distancing elements may be attached to each other, wherewith the combination can be inserted as an elongated element into the grooves.

The inventive roll-type crusher is comprised of at least one crushing roll of a type described above.

Figure 2:
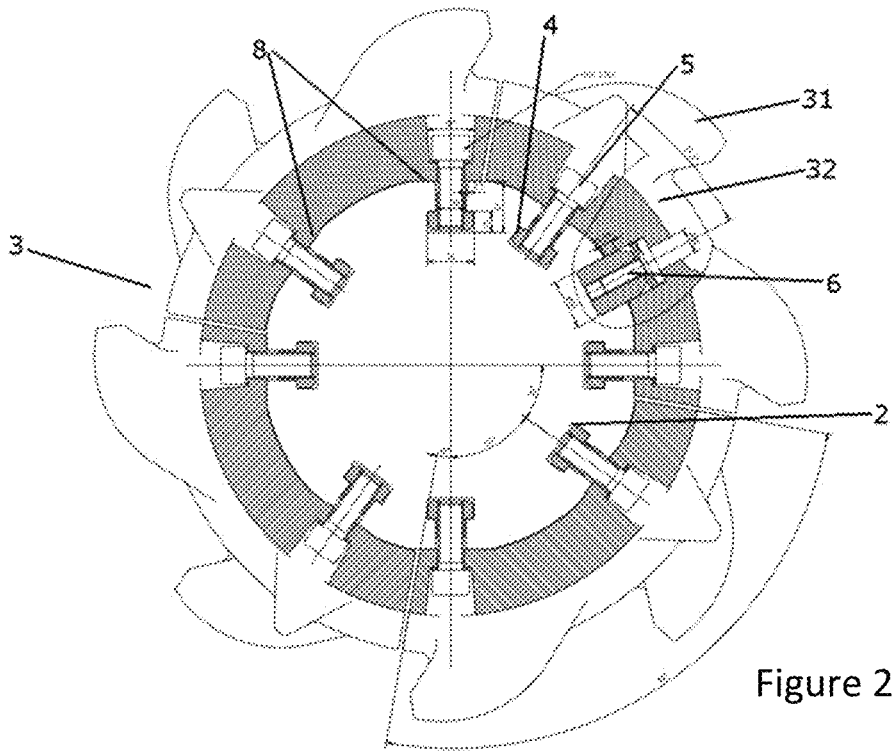
FIG. 2 is a cross sectional view of one embodiment of a crushing roll of the present invention.

Referring to the drawings, various aspects of the present invention are illustrated in the embodiments shown in FIGS. 1 and 2. In referring to the drawings, various reference numerals are used, as set forth in Table 1 below.

TABLE 1

List of Reference Numerals Used in the Drawings

| Reference Numeral | Description of Element |
|---|---|
| 1 | Shaft |
| 11 | Bearing End |
| 2 | Groove |
| 3 | Crushing Roll |
| 31 | Crushing Implement |
| 32 | Crushing Shell |
| 4 | Formed Element |
| 5 | Screw |
| 6 | Adjusting Bolt |
| 7 | Receiving Means for Adjusting Bolt |
| 8 | Flattened Region |

FIG. 1 illustrates one embodiment of shaft 1 of the present invention. A plurality of axially directed grooves 2 are distributed over the periphery of the shaft 1. The grooves 2 are T-shaped, with the vertical part of the T being radially directed and facing outward. The grooves 2 are open at their ends, so that formed elements can be inserted from the exterior. The shaft 1 has bearing ends 11 at its ends, by means of which the shaft 1 is rotatably mounted.

Further, the shaft 1 has bores on its lateral surface, which bores serve as receiving means 7 for adjusting bolts 6 (shown in FIG. 2). The adjusting bolts 6 (shown in FIG. 2) also serve to increase the stability of the crushing roll, by blocking tangential and axial movements of the crushing shells 32 (shown in FIG. 2).

FIG. 2 is a cross sectional view of one embodiment of a crushing roll 3 of the present invention. On its exterior, the crushing roll 3 has crushing implements 31 on the crushing shells 32. The crushing shells 32 rest on the shaft 1. Formed elements 4 are disposed in the grooves 2 of the shaft 1; each such element 4 has a threaded bore extending in the direction of the groove 2. Screws 5 are passed through openings in the crushing shells 32, which screws serve to fix the crushing shells 32 in the formed elements 4. In the region of the grooves 2, the shaft 1 has flattened regions 8; this enables flat support of the crushing shells 32.

By means of the shaft, it is possible to exchange crushing shells individually, in the assembled state of the crushing roll. Significantly, the configuration is easy and thereby economical to fabricate.

As set forth herein, embodiments of the present invention discussed herein have been described by way of example in this specification. Having thus described the basic concept of the invention, it will be rather apparent to those of ordinary skill in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and the scope of the invention. Additionally, the recited order of processing elements or sequences, or the use of numbers, letters, or other designations therefore, is not intended to limit the claimed processes to any order, except as may be specified in the claims. Accordingly, the invention is limited only by the following claims and equivalents thereto.

What is claimed is:

1. A crushing roll (3) for a roll crusher, said crushing roll (3) consisting of:

(a) a shaft (1) consisting of:

a plurality of grooves (2) extending in an axial direction and directly aligned in the shaft;

(ii) formed elements (4) disposed in the plurality of grooves, said plurality of grooves (2) being configured to receive the formed elements (4) so as to form a form-interlockingly engaging combination with the plurality of grooves (2) of the shaft (1) in a radial direction; and (iii) adjusting bolts (6) and bores for receiving the adjusting bolts (6) on the shaft's (1) lateral surface; and (b) crushing shells (32) fixed in the formed elements (4) by radially directed screws (5), said crushing shells (32) being anchored by the formed elements (4) in the plurality of grooves (2), wherein the formed elements (4) have a threaded bore which is disposed such that the radially directed screws (5) can be retained by the plurality of grooves (2), in order to attach the crushing shells (32), and wherein movements of the crushing shells (32) in a tangential and axial direction of the shaft (1) are blocked by the adjusting bolts (6) and bores (7) combination.

2. The crushing roll (3) according to claim 1, wherein the plurality of grooves (2) are T-shaped.

3. The crushing roll (3) according to claim 1, wherein the shaft (1) is flattened in an area of the plurality of grooves (2).

4. The crushing roll (3) according to claim 1, wherein the plurality of grooves (2) are open on an end face of the shaft (1), so that the formed elements (4) may be slid in from the end face of the shaft (1).

5. The crushing roll (3) according to claim 1, wherein a series of crushing shells (32) disposed adjacently in the axial direction are anchored in at least two of the plurality of grooves (2).

6. A roll crusher comprised of at least one crushing roll (3) according to claim 1.

7. The roll crusher according to claim 6, wherein the plurality of grooves (2) are T-shaped.

8. The roll crusher according to claim 6, wherein the shaft (1) is flattened in an area of the plurality of grooves (2).

9. The roll crusher according to claim 6, wherein the plurality of grooves (2) are open on the end sides of the shaft (1), so that the formed elements (4) may be slid in from the end face of the shaft (1).

10. The roll crusher according to claim 6, wherein a series of crushing shells (32) disposed adjacently in the axial direction are anchored in at least two of the plurality of grooves (2).

* * * * *